United States Patent [19]

Pfister

[11] Patent Number: 4,744,472

[45] Date of Patent: May 17, 1988

[54] PILE TABLE FOR SMALL OFFSET PRINTING MACHINES

[75] Inventor: Reiner Pfister, Nussloch, Fed. Rep. of Germany

[73] Assignee: Heidelberger Druckmaschinen AG, Heidelberg, Fed. Rep. of Germany

[21] Appl. No.: 88,039

[22] Filed: Aug. 19, 1987

Related U.S. Application Data

[63] Continuation of Ser. No. 848,303, Apr. 4, 1986, abandoned.

[30] Foreign Application Priority Data

Apr. 4, 1985 [DE] Fed. Rep. of Germany ... 8510062[U]

[51] Int. Cl.[4] ..... A47F 7/00

[52] U.S. Cl. ..... 211/50; 16/340; 16/367; 271/30.1; 271/127; 271/148; 248/184

[58] Field of Search ..... 211/50, 51; 108/4, 6; 271/30.1, 127, 148; 16/340, 367; 248/184, 179, 371, 398

[56] References Cited

U.S. PATENT DOCUMENTS

| | | | |
|---|---|---|---|
| 1,441,942 | 1/1923 | Owen | 248/371 |
| 2,500,048 | 3/1950 | Stoiber | 248/184 |
| 3,970,274 | 7/1976 | Resk | 248/371 X |
| 4,018,104 | 4/1977 | Bland et al. | 16/340 X |
| 4,188,026 | 2/1980 | Nagai | 271/148 |

*Primary Examiner*—Ramon S. Britts
*Assistant Examiner*—Blair M. Johnson
*Attorney, Agent, or Firm*—Herbert L. Lerner; Laurence A. Greenberg

[57] ABSTRACT

Pile table for a small offset printing machine and for receiving a pile of flat workpieces to be printed, the workpieces, respectively, being of nonuniform thickness over the area thereof, includes a pile carrying plate, a double pivot bearing pivotally mounting the pile carrying plate, the double pivot bearing having a first swivel axis extending in a direction in which the flat workpieces are transported in the printing machine and a second swivel axis extending transversely to the direction, and an actuating lever secured to the pile carrying plate for manually swivelling the plate.

5 Claims, 2 Drawing Sheets

20
53
38
37
33
50
43
36
40
39
51
34
35
49
52
32
41
46
42
50
45
51
48
29
43
44
47
31
30
28
23

20
36
35
53
37
47
49
48
41
45
43
40
39
29
50
44
42
47
41
28
43
51
31
37
50
32

PILE TABLE FOR SMALL OFFSET PRINTING MACHINES

This application is a continuation of application Ser. No. 848,303, filed Apr. 4, 1986, now abandoned.

The invention relates to a pile table for small offset printing machines and, more particularly, to such a pile table for receiving a pile of flat workpieces to be printed, which are respectively of unequal or nonuniform thickness as viewed over the surface thereof, such as envelopes, especially.

Small offset printing machines are often installed for printing envelopes with diverse addresses or other printings. In this regard, the envelopes are piled or stacked at the feeder of the small offset printing machine, are individually separated from the stack by a singling or isolating device and fed to the printing unit by a feeding device.

Due to the gummed or adhesive flap at one of the edges of each of the envelopes, an inclined positioning of the envelopes takes place, at least in the direction of conveyance of the envelopes, with increasing growth of the pile or, depending upon the orientation of the gummed flap, also transversely to this direction. Other causes which are not directly foreseeable, can also produce a decided inclined positioning of the pile. This is disadvantageous because the singling or individually isolating device can operate optimally only if the respective uppermost envelope to be isolated or separated from the pile is disposed substantially horizontally.

In the heretofore known state of the art, attempts have been made to achieve this result by tilting or inclining the pile-carrying board or plate in the envelope conveyance or transport direction before the pile is introduced into the feeder. It has also been known to place wedges under the envelope pile to accomplish this objective In addition to often costly handling, a disadvantage peculiar to the first-mentioned procedure is that it is practically impossible or only possible to an unsatisfactory extent to vary the angle of inclination of the pile-carrying plate or board during the printing operation. This would be necessary, however, because the inclined disposition of the respectively upper envelope also varies as the height of the pile decreases.

Starting from this state of the art, it is an object of the invention to provide a pile table for small offset printing machines having the foregoing application and by means of which it is possible to adjust optimally the inclined position of the pile-carrying board or plate to every shape of the pile at any time during the printing operation in order to ensure that the uppermost envelope is disposed horizontally at whatever height of the pile.

With the foregoing and other objects in view, there is provided, in accordance with the invention, a pile table for a small offset printing machine and for receiving a pile of flat workpieces to be printed, the workpieces, respectively, being of nonuniform thickness over the area thereof, comprising a pile carrying plate, a double pivot bearing pivotally mounting the pile carrying plate, the double pivot bearing having a first swivel axis extending in a direction in which the flat workpieces are transported in the printing machine and a second swivel axis extending transversely to the direction, and an actuating lever secured to the pile carrying plate for manually swivelling the plate.

In accordance with another feature of the invention,- the pile table includes means for mounting and securing the pile table on a pile base table through the intermediary of an automatic height adjustment device.

In accordance with a further feature of the invention, the pile table includes a base plate having a U-shaped bracket secured thereto so that the legs of the U extend away from the base plate, a correspondingly dimensioned double bracket engaging in the space between the legs, the double bracket being formed of two U-shaped brackets turned through an angle of 90 degrees with respect to one another and having the open spaces between the respective legs thereof facing towards one another, the actuating lever comprising a pair of spaced bellcranks, respectively, having a short and a long arm and engaging in the U-shaped bracket of the double bracket which is located farther from the base plate, the short arms of the bellcranks being secured to the pile carrying plate, the long arms of the bellcranks extending beyond the pile carrying plate and carrying a handle therebetween.

In accordance with an additional feature of the invention,the pile table includes respective clamping screws forming articulating joints between the double bracket and the U-shaped bracket secured to the base plate and between the double bracket and the actuating lever, the clamping screws extending through respective spacer members and cup springs disposed within the space between the U for effecting a self-holding action of a set position of the pile carrying plate due to a friction lock resulting from the clamping force of the clamping screws.

In accordance with a concomitant feature of the invention, the pile table includes a cover plate having a greater base area than the pile carrying plate and being mountable on and securable to the pile carrying plate.

Other features which are considered as characteristic for the invention are set forth in the appended claims.

Although the invention is illustrated and described herein as a pile table for small offset printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
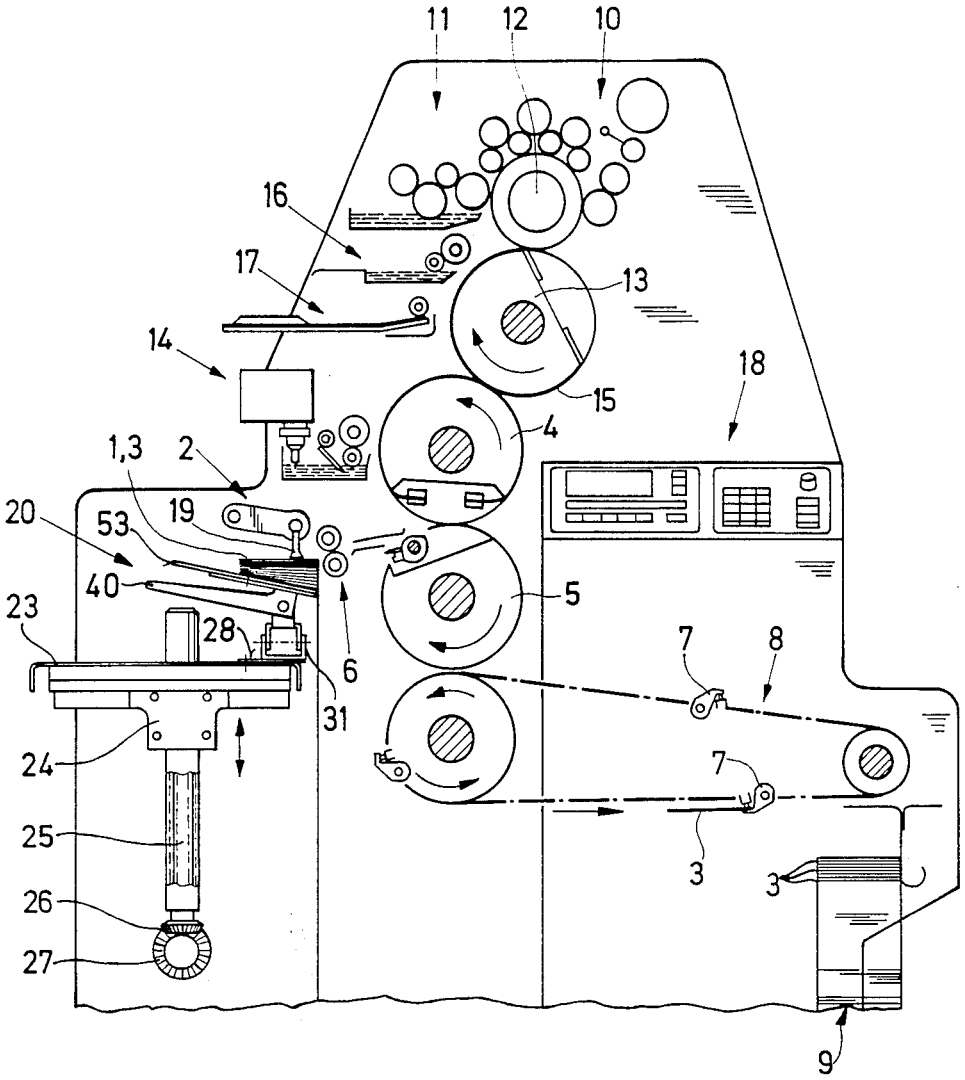
FIG. 1 is a diagrammatic elevational view of a small offset printing machine with a pile table constructed in accordance with the invention.

Referring now to the drawing and first, particularly, to FIG. 1 thereof, there is shown a small offset printing machine wherein a pile or stack 1 of envelopes 3 are fed by a singling or individually isolating device 2 via a feeder 6 into a gap between a blanket cylinder 4 and an impression cylinder 5. The printing operation occurs at that location. The thus printed envelopes 3 are then gripped by a chain delivery 8 provided with gripper rows 7 and are fed to a delivery pile 9. It would also be conceivable naturally in this case to employ a trough feeder such as is conventional with small offset printing machines.

The printed image is transferred via a dampening unit 10 as well as an inking unit 11 with a brayer or form roller 12, which inks a plate cylinder 13, to the blanket cylinder 4 which makes the impression. A blanket washing device 14 is associated with the blanket cylinder 4 while an etching device 16 is provided for the printing plate 15 and, moreover, an introduction device 17 for the printing plate 15 can be associated with the plate cylinder 13. The printing machine is controlled by a control desk or hoard 18 provided with appropriate keyboards.

The singling or individually separating device 2 which operates with pivotal suction heads 19 removes the respectively uppermost envelope 3 which should advantageously be horizontally disposed. Because the respectively uppermost envelope 3 should furthermore always be at the same level for an optimum singling or individually isolating operation, it is necessary, due to the reducing pile height, to construct the device carrying the pile 1 so that it is, for example, automatically adjustable in height.

For this purpose, a pile base table 23 is provided which is mounted on a holder 24 cooperating with a laterally disposed threaded spindle 25. The latter carries a bevel gear 26 at the lower end thereof, as viewed in FIG. 1, which cooperates with a further bevel gear 27 which acts as the drive. The particular control system of the drive for continuously raising the base table 23 is not the subject of the invention of the instant application nor essential thereto and is therefore not described in detail herein.

Figure 2:
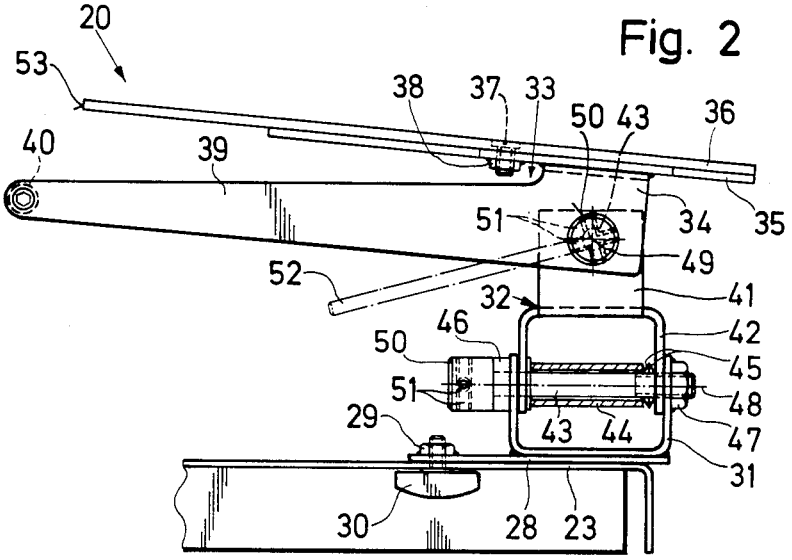
FIG. 2 is an enlarged fragmentary view of FIG. 1 showing the pile table in greater detail.
Figure 3:
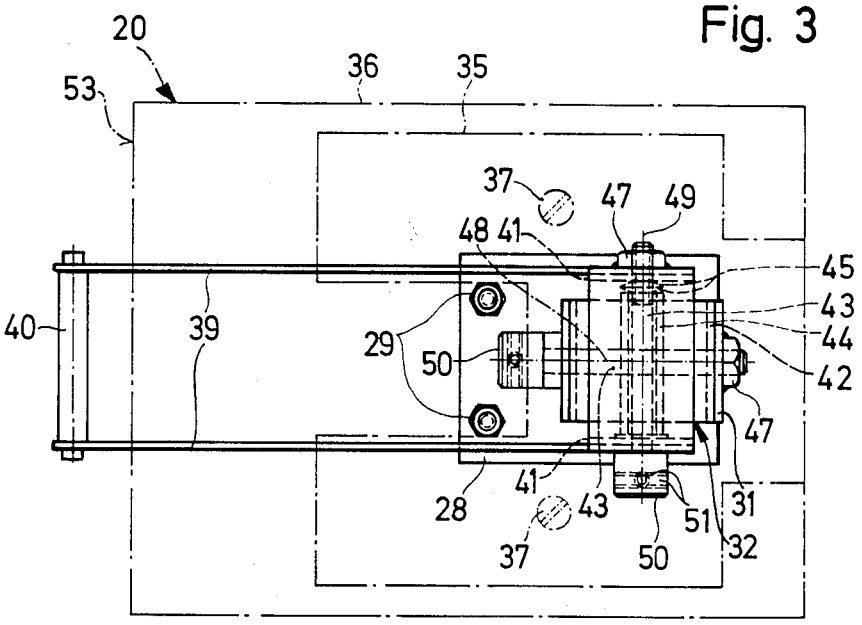
FIG. 3 is a top plan view of FIG. 2.

A pile table 20 constructed in accordance with the invention is disposed on the pile base table 23. The detailed construction thereof is shown in the enlarged views of FIGS. 2 and 3.

The pile table 20 is formed first of a base plate 28 which is fastened to the pile base table 23 by means of a nut 29 welded to the base plate 28 and a thumb screw 30 cooperating with the nut 29. A U-shaped bracket 31 is affixed to the base plate 28 by a welded joint. In the interior opening of the U-shaped bracket 31, a suitably dimensioned double bracket 32 having two bracket parts 41 and 42 rotated 90 degrees with respect to one another and having their respective openings opposing one another is mounted. A double-armed bellcrank or angle lever 33 engages in the upper bracket part 41, as viewed in FIG. 2, a pile plate 35 being fastened, for example, by a welded connection to the short lever arm 34 thereof. The pile 1 formed of the individual envelopes 3 is disposed on this pile plate 35 although not shown in FIGS. 2 and 3. If these envelopes have appropriate dimensions, it is conceivable to fasten a cover plate 36 having dimensions of corresponding size to the pile plate 35 by a threaded connection such bolts 37 and 38.

A long lever arm 39 of the double-armed bellcrank 33 projects beyond the rear edge 53 of the cover plate 36 and has a handle 40 connecting both webs of the long lever arm 39.

An articulating connection or hinged joint between the bracket 31, the double bracket 32 and the bellcrank 33 is formed, respectively, by a clamping screw 43. A spacer member 44 together with a pair of cup or Belleville springs 45 is provided within the U-shaped openings of the aforementioned components. The clamping screw 43 engages through the intermediary of a washer 46 in a nut 47 and, by means of a suitable clamping force, effects a pretensioning of the cup springs 45. Due to the resulting frictional lock or connection, a self-holding action of the inclined position of the pile plate 35 and the cover plate 36, respectively, set manually by the handle 40 is achieved.

The swivel axes 48 and 49 of the double pivot bearing extend in the sheet transport or conveying direction and transversely to this direction, respectively.

Thus, it is always possible to set the desired inclined position of the pile plate 35 and the cover plate 36, respectively, so that horizontal positioning of the respectively upper envelope 3 can be achieved.

For the purpose of adjusting the clamping force by means of the clamping screw 43, bores 51 are formed at the upper end of the head 50 thereof, into which an adjusting lever 52 is insertable as an auxiliary device.

The foregoing is a description corresponding, in substance, to German Application No. G 85 10 062.5, dated Apr. 4, 1985, the International Priority of which is being claimed for the instant application, and which is hereby made part of this application. Any material discrepancies between the foregoing specification and the specification of the aforementioned corresponding German application are to be resolved in favor of the latter.

I claim:

1. Pile table for a small offset printing machine and for receiving a pile of flat workpieces to be printed, the workpieces, respectively, being of nonuniform thickness over the area thereof, comprising a pile carrying plate, a double pivot bearing pivotally bearing said pile carrying plate, and including a lower and an upper part, said lower part being secured to a height adjustment device for the pile table and having a lower swivel axis extending in a direction in which flat workpieces are transported in the machine, said upper part being pivotally connected to said lower part at said lower swivel axis, means for producing adjustable friction forces between said lower and upper parts so as to hold said upper part in position, said upper part having an upper swivel axis extending in a direction transverse to said direction in which the flat workpieces are transported in the machine and an actuating lever pivotally connected to said upper part at said upper swivel axis, means for producing adjustable friction forces between said actuating lever and said upper part so as to hold said actuating lever in position, said actuating lever having a long arm and a short arm, said long arm carrying a handle and extending beyond said pile carrying plate in a substantially opposite direction to said direction in which the flat workpieces are transported in the machine, said short arm being secured to said pile carrying plate.

2. Pile table according to claim 1 including means for mounting and securing the pile table on a pile base table through the intermediary of an automatic height adjustment device.

3. Pile table for a small offset printing machine and for receiving a pile of flat workpieces to be printed, the workpieces, respectively, being of nonuniform thickness over the area thereof, comprising a pile carrying plate, a double pivot bearing pivotally bearing said pile carrying plate in positions which are set due to adjustable friction forces within said double pivot bearing, said double pivot bearing having a first swivel axis extending in a direction in which the flat workpieces are transported in the printing machine and a second swivel axis extending transversely to said direction, means for producing said adjustable friction forces within said double bearing, and an actuating lever secured to said pile carrying plate for manually swivelling said plate, said actuating lever being mounted so as to pivot together with said pile carrying plate about said second swivel axis generally in said direction in which the workpieces are transported as well as about said first swivel axis generally in a direction transverse to said first-mentioned direction, a base plate having a U-shaped bracket secured thereto so that the legs of the U extend away from said base plate, and a correspondingly dimensioned double bracket engaging in the space between said legs, said double bracket being formed of two U-shaped brackets turned through an angle of 90 degrees with respect to one another and having the open spaces between the respective legs thereof facing towards one another, said actuating lever comprising a pair of spaced bellcranks, respectively, having a short and a long arm and engaging in the U-shaped bracket of said double bracket which is located farther from said base plate, said short arms of said bellcranks being secured to said pile carrying plate, said long arms of said bellcranks extending beyond said pile carrying plate and carrying a handle therebetween.

4. Pile table according to claim 3, including respective clamping screws forming articulating joints between said double bracket and said U-shaped bracket secured to said base plate and between said double bracket and said actuating lever, said clamping screws extending through respective spacer members and cup springs disposed within the space between said U for effecting a self-holding action of a set position of said pile carrying plate due to a friction lock resulting from the clamping force of said clamping screws.

5. Pile table according to claim 1, including a cover plate having a greater base area than said pile carrying plate and being mountable on and securable to said pile carrying plate.

* * * * *